US005097742A

United States Patent [19]

Gaye et al.

[11] Patent Number: 5,097,742

[45] Date of Patent: Mar. 24, 1992

[54] MAGAZINE CONVEYOR WITH AMMUNITION VERTICAL MOTION RESTRAINT

[75] Inventors: John H. Gaye, Essex Jct.; Robert G. Turner, Charlotte, both of Vt.

[73] Assignee: General Electric Company, Burlington, Vt.

[21] Appl. No.: 633,552

[22] Filed: Dec. 24, 1990

[51] Int. Cl.[5] ..... F41A 9/79

[52] U.S. Cl. ..... 89/34; 89/35.01; 89/40.07

[58] Field of Search ..... 89/1.801, 1.802, 33.14, 89/33.16, 33.2, 33.25, 34, 35.01, 40.07, 46

[56] References Cited

U.S. PATENT DOCUMENTS 4,429,615 2/1984 Morris ..... 89/33.14

FOREIGN PATENT DOCUMENTS 3722353 1/1989 Fed. Rep. of Germany ..... 89/46

*Primary Examiner*—Stephen C. Bentley

*Attorney, Agent, or Firm*—Bailin L. Kuch; Robert A. Cahill

[57] ABSTRACT

An ammunition conveyor is equipped to accommodate projectiles and propellant in alternating carrier positions. Conveyor cross members or rungs carry retainers to engage the projectile and propellant canister bodies and provide lateral restraint preserving their vertical orientations in the carrier positions. The rungs also carry vertical restraints which project out into engaging relation with the projectiles and propellant canisters to preclude hazardous vertical movements during field transport of the magazine. The vertical restraints are structured to automatically accommodate projectiles and propellant canisters of different length dimensions.

12 Claims, 3 Drawing Sheets

MAGAZINE CONVEYOR WITH AMMUNITION VERTICAL MOTION RESTRAINT

This invention was made with Government support under Contract No. DAAA-21-88-C-0161 awarded by the U.S. Army. The Government has certain rights in this invention.

BACKGROUND OF THE INVENTION

The present invention relates to ammunition magazines and particularly to magazine conveyors for storing and handling large caliber ammunition.

Heretofore, the task of handling ammunition for large caliber artillery pieces, such as howitzers, has been highly labor intensive and time consuming. To reduce the number of military personnel required and to save time, automated ammunition handling equipment has been proposed for conveying ammunition into and out of magazine storage.

One approach to mechanizing the handling of large caliber projectiles has been to provide an X-Y stacker mechanism for conveying the projectiles to and from a stationary magazine storage rack having a matrix array of storage tubes or "pigeon holes". To safely retain the projectiles in their storage pigeon holes during transport on rearm vehicles supporting howitzers in the field, spring loaded pads are disposed to bear against the projectile cylindrical bodies. While this approach is effective in protecting the projectiles from damage during transport over rough terrain, the X-Y stacker mechanism approach is complicated, and the storage and retrieval process is quite slow.

A more promising approach is to provide an ammunition conveyor trained throughout the interior of a magazine. While the conveyor is in motion, ammunition rounds are handed off to the conveyor during uploading and are handed off form the conveyor during downloading. While the conveyor is stopped, the uploaded ammunition rounds remain in magazine storage positions on the conveyor. Uploading and downloading can be accomplished expeditiously in a highly automated manner. While mechanizing the handling and storage of large caliber ammunition utilizing the handling and storage of large caliber ammunition utilizing a magazine conveyor is not particularly complex, this approach is not without complications. The conveyor should accommodate both projectiles and propellant canisters as separate ammunition units required by howitzers. The magazine conveyor must be capable of safety storing projectiles and propellant canisters during transport over rough terrain in a resupply vehicle. Thus, retainers are required to positively control the positions of the projectiles and propellant canisters on the conveyor during conveyance and while stationary in magazine storage locations. These retainers must be structurally robust to control projectiles weighing in the neighborhood of one hundred pounds, must be adapted to different types and sizes of both projectiles and canisters, and also must not hinder uploading and downloading.

SUMMARY OF THE INVENTION

It is accordingly an object of the present invention to provide an improved magazine conveyor for storing and conveying large caliber ammunition into and out of magazine storage.

A further object is to provide an improved magazine conveyor of the above-character, which is capable of handling ammunition rounds in the form of projectiles and propellant canisters of differing dimensional characteristics.

Another object is to provide an improved magazine conveyor of the above-character, wherein ammunition rounds are reliably retained in positions on the conveyor to withstand vibration and shock loading during transport.

An additional object is to provide an improved magazine conveyor of the above-character, wherein the ammunition rounds are secured in their conveyor positions in a manner to preclude damage to the ammunition, as well as the conveyor.

An additional object is to provide an improved magazine conveyor of the above-character, wherein the conveyor position restraint features accommodate automated handoffs of ammunition rounds to and from the conveyor.

Yet another object is to provide an improved magazine conveyor of the above-character, wherein the conveyor position restraint features are automatically adaptable to different sizes of projectiles and different sizes of propellant canisters.

Another object is to provide an improved magazine conveyor of the above-character, wherein he conveyor position restraint features are efficient and robust in construction, and reliable in operation.

Other objects of the invention will in part be obvious and in part appear hereinafter.

In accordance with the present invention, there is provided a magazine conveyor specially adapted to mobile installations, such as an ammunition rearm vehicle providing battlefield logistical support to large caliber artillery pieces, such as howitzers. To this end, the conveyor includes upper and lower conveyor chains interconnected at regular intervals by rungs. The lower chain consists of pivotally interconnected load-bearing links on which the projectiles and propellant canisters rest in vertical orientation. The spaces between rungs define carrier positions for projectiles and propellant canisters in alternating arrangement. Each rung carries several vertically spaced retainers in partially cradling relation with the cylindrical bodies of the projectiles and propellant canisters to preserve their upright stance on the load-bearing links. To provide vertical motion restraint to the projectiles in their carrier positions, alternate first rungs carry pairs of forked stops, an upper one in a fixed operative position and a lower movable one spring-biased to an operative position.

When short projectiles are loaded into projectile carriers positions, the lower stops are operatively positioned to confront the ogives thereof and thereby restrain vertical motion. When tall projectiles are loaded into the projectile carrier positions, the lower stops are cammed aside by the projectile bodies, and the upper stops are positioned to confront the ogives and restrain projectile vertical motion.

Alternate second rungs carry pivoting stops spring biased to operative positions confronting the upper ends of short, non-flanged propellant canisters standing in propellant carrier positions to provide vertical motion restraint. When tall, flanged propellant canisters are loaded into propellant carrier positions, the stops are cammed aside, leaving vertical motion restraint to a magazine-mounted guide rib positioned in close overlapping relation with propellant canister annual flanges.

The invention accordingly comprises the features of construction, combination of elements, and arrangement of parts, all as detailed hereinafter, and the scope of the invention will be indicated in the claims.

BRIEF DESCRIPTION OF THE DRAWINGS

For a full understanding of the nature and objects of the present invention, reference may be had to the Detailed Description, taken in connection with the following drawings, in which.

Corresponding reference numerals refer to like parts throughout the several views of the drawings.

DETAILED DESCRIPTION

Figure 1:
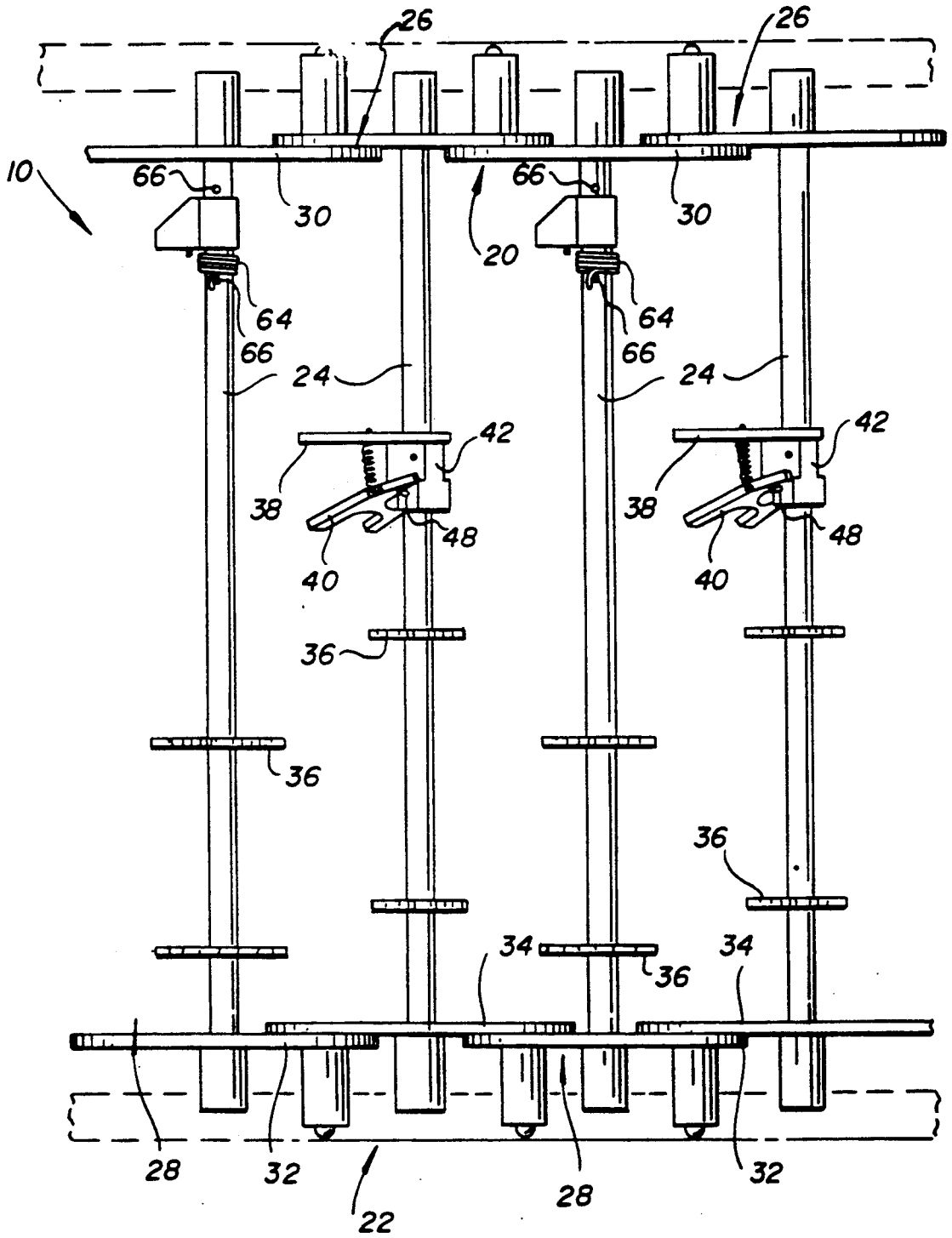
FIG. 1 is a side view of a representative segment of a magazine conveyor constructed in accordance with the present invention to handle large caliber ammunition comprising separate projectiles and propellant canisters.

The magazine conveyor of the present invention, generally indicated at 10 in FIG. 1, handles large caliber artillery ammunition while in magazine storage and during conveyance into and out of storage. More specifically, conveyor 10 handles projectiles, such as indicated at 12 in FIG. 2 and 13 in FIG. 3, as well as propellant canisters, such as indicated at 16 in FIG. 4 and 18 in FIG. 5. The conveyor comprises an endless upper chain, generally indicated at 20, and an endless lower chain, generally indicated at 22, which are interconnected at regularly spaced intervals by a succession of rungs 24. The spaces between rungs define alternating projectile carrier positions, generally indicated at 26, and propellant carrier positions, generally indicated at 28.

The upper chain 20 comprises a series of pivotally interconnected links 30, while the lower chain 22 comprises a series of pivotally interconnected load bearing links 32. The load bearing links provide platforms 34 on which projectiles rest in vertical orientation in projectile carrier positions 26 and propellant canisters rest in vertical orientation in propellant carrier positions 28. The conveyor chains may be equipped with alternating ball castors and posts, such as disclosed in commonly assigned, copending application entitled Magazine Conveyor For Large Caliber Ammunition, Ser. No. 07/633,553, to accommodate conveyor support, guidance, and drive along a predetermined path within a magazine. The disclosure of this copending application is specifically incorporated herein by reference.

To maintain the vertical orientations of the projectiles and propellant canisters in their respective carrier positions on the conveyor, each rung carries several vertical spaced retainers 36 equipped with opposed cradle elements configured to generally conform to and partially wrap about the cylindrical body of a projectile standing in the projectile carrier position 26 to one side of each rung and to generally conform to and partially wrap about the cylindrical body of a propellant canister standing in the propellant canister position on the other side of each rung. Thus, the projectiles and propellant canisters are engaged by cradle elements over diametrically opposed portions of their body peripheral surfaces to positively control their upright stances on the conveyor during storage and while under conveyance incident to uploading and downloading operations. The retainers 36 open as the conveyor positions transit a 180° turnaround in the conveyor path to accommodate handoffs of projectiles and propellant canisters to and from the conveyor.

While the retainers 36 are effective in laterally retaining the projectiles and propellant canisters to control their upright orientations, they are not particularly effective as vertical motion restraints. Projectiles can weight as much as one hundred pounds and propellant canisters can range from twenty-five to fifty pounds. During transport over rough terrain in a rearm vehicle, the projectiles and propellant canisters are subjected to vibrational and shock loadings, which cause them to rise off their platform rests. Prolonged vertical shifting can do damage to the ammunition cargo and, if excessive, the cargo can inflict damage on the conveyor.

Figure 2:
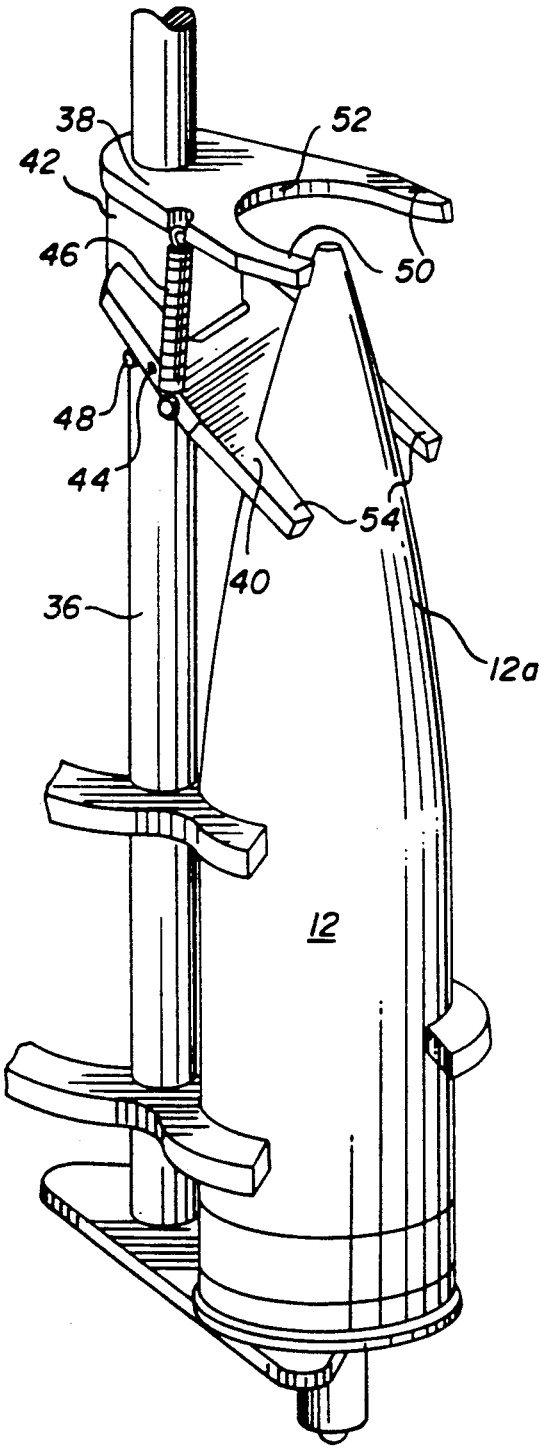
FIG. 2 is a perspective view of a projectile carrier position on the conveyor illustrating vertical motion restraint of a short projectile standing therein.
Figure 3:
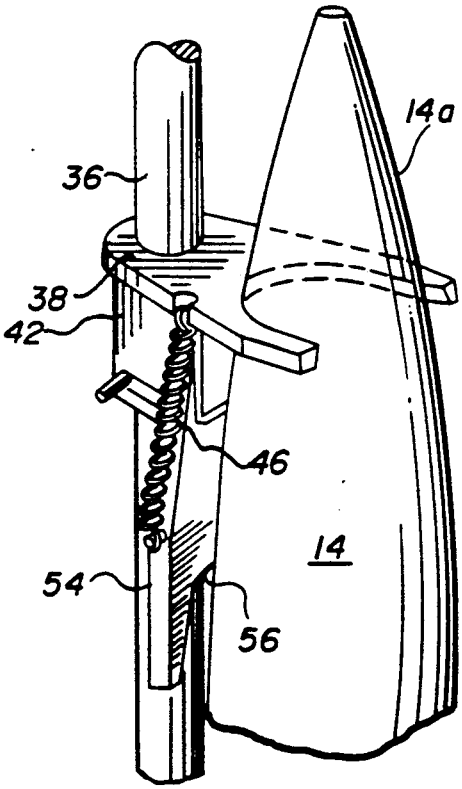
FIG. 3 is a fragmentary perspective view illustrating vertical motion restraint of a tall projectile standing in a projectile carrier position.
Figure 4:
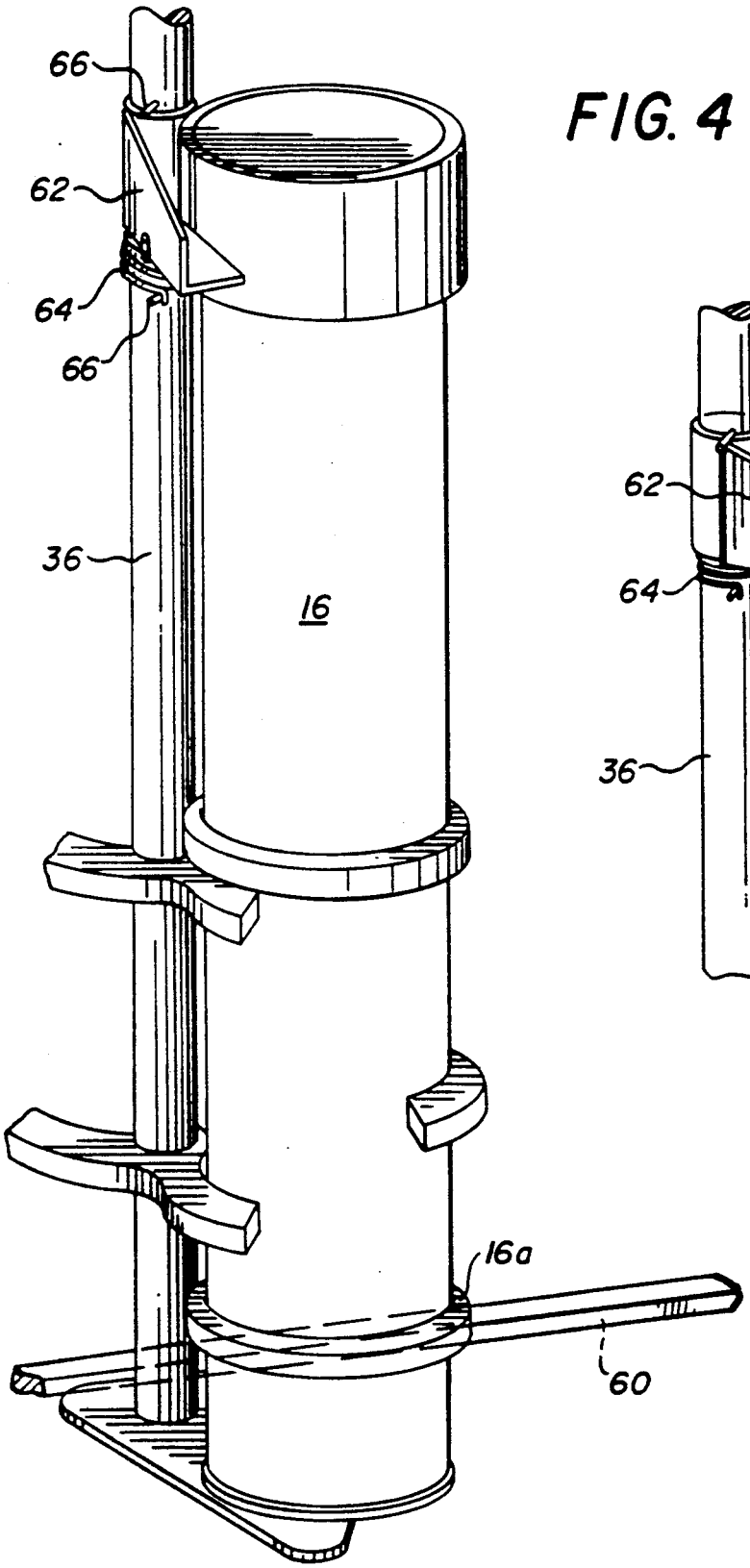
FIG. 4 is a perspective view of a propellant carrier position on the conveyor illustrating vertical motion restraint of a tall, flanged propellant canister standing therein.

To avoid this problem, the present invention provides various forms of restraints to preclude vertical movements of different sizes of projectiles and propellant canisters. Referring jointly to FIGS. 1–3, alternate rungs 24 carry a pair of projectile stops 38 and 40 which are jointly mounted by a bracket 42 pinned to the alternate rungs in appropriate positions above the highest retainers 36. Each projectile stop 38 is affixed to its bracket to project generally horizontally out into a projectile carrier position 26. Projectile stop 40 is pivotally mounted to its bracket by a pin 44 beneath fixed projectile stop 38 for movement between an operative position projecting angularly downward into a projectile carrier position 26 seen in FIG. 2 and a folded back inoperative position seen in FIG. 3. A tension spring 46, connected between the upper and lower stops, biases the latter to its operative position established by bracket mounted stop posts, one seen at 48. The free end of each fixed projectile stop 38 is bifurcated to provide laterally spaced arms 50 and an intervening, arcuate bight 52. The free end of each pivotal stop 40 is similarly bifurcated to provide laterally spaced arms 54 and an intervening bight 56.

An seen in FIG. 2, when short projectiles 12 are loaded into projectile carrier positions 26, the arms 54 of lower stops 40 straddle the projectile conical surface or ogive **12*a* with their bights 56 confronting the ogive to restrain the projectiles form significant vertical upward movement. A small clearance is maintained between the projectiles 12 and stop 40 to minimize impact loading when the projectiles rise up against the stops. The loading is passed through the forks into their mounting brackets 42 via stop posts 48 and pivot pins 44 and through rungs 24 to the conveyor guide structure (not shown). It is seen that upper projectile stops 38 are in fixed positions well above projectiles 12, and thus do not interfere with loading and unloading of the short projectiles into and out of carrier positions 26**.

When tall projectiles 14 are loaded into carrier positions 26, they engage the tips of the lower stop arms 54, readily causing the lower stops 40 to pivot donwwardly about their pivot pins 44 into the folded back, vertical inoperative positions seen in FIG. 3. The arms 50 of the fixed upper stops 38 straddle the projectile ogive **14*a*** with bight 52 confronting the ogive to restrain the tall projectiles from hazardous vertical motion. When a tall projectile 14 is downloaded from a carrier position 26, stop 40 springs back to its operative position under the bias of spring 46, ready to vertically restrain a subsequently loaded short projectile 12. Thus, the projectile vertical motion restraint of the present invention automatically differentiates between tall and short projectiles as they are being uploaded into their conveyor positions to achieve the restraint objective without resort to a complex mechanism and/or projectile size sensors. It will be noted that either of stops 38 and 40 are effective, regardless of the mix of projectiles 12 and 14 on conveyor 10. Moreover, these projectile stops do not interfere with lateral handoffs of projectiles to and from the conveyor during uploading and downloading operations.

To vertically restrain tall, flanged propellant canisters 16 standing in alternate carrier positions 28, a magazine mounted guide rib 60 runs along a side of the conveyor path at an appropriate height to closely overlap a portion of an annular canister flange 16*a*. Should a tall propellant canister attempt to rise up from its platform rest 34, canister flange 16*a* engages rib 60 to afford effective vertical restraint.

Figure 5:
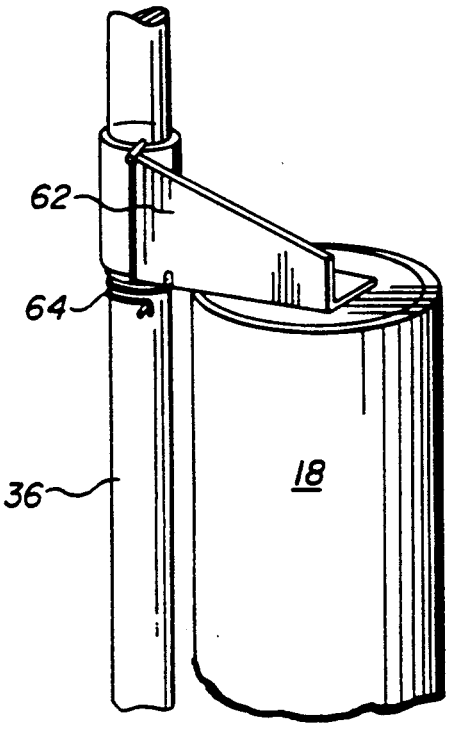
FIG. 5 is a perspective view illustrating vertical motion restraint of a short non-flanged propellant canister standing in a propellant carrier position.

The conveyor is also required to accommodate short, unflanged propellant canisters 16 in carrier positions 28. To provide vertical restraint for these canisters, alternate rungs 24 are each provided with a pivotally mounted propellant stops in the form of a gate 62 biased by a torsion spring 64 to an operative position projecting into an adjacent propellant carrier position 28, as seen in FIG. 1. The vertical positions of the gates on their rungs are maintained by upper pins 66 and springs 64. The height of the gate operative positions relative to platforms 34 is slightly in excess of the length of propellant canisters 16. Thus, when these canisters are loaded into carrier positions 28, the gates 62 are in their spring-biased operative positions immediately above the canister upper ends to provide the requisite vertical restraint as seen in FIG. 5. From FIG. 4, it is seen that when the tall canisters 14 are loaded into carrier positions 28, they engage gates 62, swinging them horizontally aside to inoperative positions removed from the propellant carrier positions. As in the case of projectile stops 40, when canisters 14 are downloaded from carrier positions 28, the gates spring back to their operative positions under the bias of springs 64 hooked at their ends to the gates and lower pins 66 (FIG. 1). It is thus seen that, as in the case of projectile vertical restraint, the propellant canister vertical restraint also automatically differentiates between the two types and sizes of propellant canisters to achieve the restraint objective in a simple, compact and efficient manner, regardless of the mix of propellant canisters 16 and 18 on conveyor 10. Also, gates 62, as well as rib 60, do not hinge propellant canister handoffs during uploading and downloading.

It is seen that the objects set forth, including those made apparent from the foregoing Detailed Description, are efficiently attained, and, since certain changes in detail maybe made in the construction set forth without departing from the scope of the invention, it is intended that matters of detail be taken as illustrative and not in a limiting sense.

Having described the invention, what is claimed as new and desired to secure by Letters Patent is:

1. A magazine conveyor for handling large caliber ammunition, said conveyor comprising, in combination:

A. an upper chain arranged in along predetermined conveyor path;

B. lower chain vertically aligned and coextensive with said upper chain, said lower chain including a series of pivotally interconnected load-bearing links providing a succession of platforms, each said platform serving as a rest for an ammunition round in an upright orientation in a carrier position on said conveyor;

C. a series of rungs interconnecting said upper and lower chains at regularly spaced intervals, the space between each adjacent pair of said rungs defining one of said carrier positions;

D. at least one retainer carried by each said rung for engaging ammunition rounds in said carrier positions to provide lateral restraint maintaining the ammunition rounds in upright orientations; and E. vertical restraint means carried by said rungs and including (1) a first stop disposed in a fixed operative position to engageably restrain an ammunition round of a first type in an adjacent said carrier position against upward movement off the underlying one of said platforms, and (2) a second stop movable between an operative position extending laterally into said adjacent carrier position and an inoperative position assumed incident to loading of an ammunition round of said first type into said adjacent carrier position, said second stop in said operative position engageably restraining an ammunition round of a second type in said adjacent carrier position against upward movement off said underlying platform, and (3) means for biasing said second stop to said operative position.

2. The magazine conveyor defined in claim 1, wherein said first stops are carried by said rungs in mounting positions above said second stops, said first stops providing vertical restraint for the first type ammunition rounds having a first length dimension, and said second stops providing vertical restraint for the second type ammunition rounds having a length dimension less than the first length dimension.

3. The magazine conveyor defined in claim 2, wherein said second stops are pivotally mounted to said rungs.

4. The magazine conveyor defined in claim 3, wherein each said first stop is bifurcated to provide a pair of first arms for straddling a conical surface of the first type ammunition round, and each said second stop is bifurcated to provide a pair of second arms for straddling a conical surface of the second type ammunition round.

5. The magazine defined in claim 4, wherein each said first stop includes a first bight intermediate said first arms for confronting the conical surface of the first type ammunition round and each said second stop includes a second bight intermediate said second arms for confronting the conical surface of the second type ammunition round.

6. The magazine conveyor defined in claim 5, wherein said second stop project angularly downward into said adjacent carrier positions while in said operative positions and project vertical downward in removed relation to said adjacent carrier positions while in said inoperative positions.

7. The magazine conveyor defined in claim 6, wherein the ammunition rounds comprise separate projectiles and propellant canisters occupying alternating projectile and propellant carrier positions on said conveyor, said first and second stops are projectile vertical restraint means carried by first said rungs to vertically restrain first and second type projectiles in said projectile carrier positions, said magazine conveyor further including separate propellant vertical restraint means to vertically restrain individual propellant canisters in each said propellant carrier position.

8. The magazine conveyor defined in claim 7, wherein said propellant vertical restraint means includes a third stop carried by each second said rungs alternating with said first rungs, each said third stop movable between an operative position immediately above the upper end of a first type of propellant canister in an adjacent said propellant carrier position and an inoperative position removed from said adjacent propellant carrier position, said propellant vertical restraint means further including a spring biasing said third stop to said operative position.

9. The magazine conveyor defined in claim 8, wherein said propellant vertical restraint means further includes a magazine-mounted rib disposed in closely overlying relation with an annular flange carried by a second type propellant canister of a length dimension greater than the first type propellant canister, said rib engaging the flanges to restrain the second type propellant canisters against upward movement off the underlying said platforms, said third stops being moved to said inoperative position incident to loading the second type propellant canisters in said propellant carrier positions.

10. A magazine conveyor for handling large caliber ammunition in the form of projectiles and propellant canisters, said conveyor comprising, in combination:

A. an upper chain arranged in along predetermined conveyor path;

B. a lower chain vertically aligned and coextensive with said upper chain, said lower chain including a series of pivotally interconnected load-bearing links providing a succession of platforms, said platforms serving as rests for projectiles and propellant canisters in an upright orientations in alternating projectile and propellant carrier positions on said conveyor;

C. a series of alternating first and second rungs interconnecting said upper and lower chains at regularly spaced intervals, the spaces between adjacent pairs of said first and second rungs defining individual said projectiles and propellant carrier positions;

D. retainers carried by said first and second rungs for engaging projectiles and propellant canisters in respective said projectile and propellant carrier positions to provide lateral restraint maintaining the upright orientations thereof;

E. first vertical motion restraint means carried by each said first rung and including (1) a first stop disposed in a fixed operative position to engageably retain a projectile of a first type in an adjacent said projectile carrier position against upward movement off the underlying one of said platforms, and (2) a second stop movable between an operative position extending laterally into said adjacent carrier position and an inoperative position assumed incident to loading of projectile of said first type into said adjacent projectile carrier position, said second stop in said operative position engageably restraining a projectile of the second type in said adjacent carrier position against upward movement off said underlying platform, and (3) means for biasing said second stop to said operative positions; and F. second vertical motion restraint means carried by each said second rung and including (1) a third stop movable between an operative position immediately above the upper and end of a first type of propellant canister in an adjacent said propellant canister position and an inoperative position removed from said adjacent propellant carrier position, and (2) a spring biasing said third stop to said operative position.

11. The magazine conveyor defined in claim 10, wherein said second vertical restraint means further includes a magazine-mounted rib disposed in closely overlying relation with an annular flange carried by a second type propellant canister of a length dimension greater than the first type propellant canister, said rib engaging the flanges to restrain the second type propellant canisters against upward movement off the underlying said platforms, said third stops being moved to said inoperative position incident to loading the second type propellant canisters in said propellant carrier positions.

12. The magazine conveyor defined in claim 11, wherein each said first stop is bifurcated to provide a pair of first arms for straddling a conical surface of the first type ammunition round, and each said second stop is bifurcated to provide a pair of second arms for straddling a conical surface of the second type ammunition round.

* * * * *